US007752784B2

(12) United States Patent
Caster

(10) Patent No.: US 7,752,784 B2
(45) Date of Patent: Jul. 13, 2010

(54) CARD CONSTRUCTION HAVING RAISED WIRE FIGURES

(76) Inventor: Catherine M. Caster, 3008 Rockbrook, Plano, TX (US) 75074

( * ) Notice: Subject to any disclaimer, the term of this patent is extended or adjusted under 35 U.S.C. 154(b) by 0 days.

(21) Appl. No.: 11/903,328

(22) Filed: Sep. 20, 2007

(65) Prior Publication Data

US 2008/0078108 A1 Apr. 3, 2008

Related U.S. Application Data

(60) Provisional application No. 60/845,984, filed on Sep. 20, 2006.

(51) Int. Cl.
*G09F 1/00* (2006.01)

(52) U.S. Cl. ..... 40/124.11; 428/542.6

(58) Field of Classification Search ..... 40/124.01, 40/124.06, 124.09, 124.11; 446/147–150, 446/486, 487; 428/7–9, 12–14, 29, 542.2, 428/542.6

See application file for complete search history.

(56) References Cited

U.S. PATENT DOCUMENTS

| | | | | |
|---|---|---|---|---|
| 285,442 | A * | 9/1883 | Sweeney | 446/149 |
| 508,149 | A * | 11/1893 | Schumm | 428/23 |
| 3,427,642 | A * | 2/1969 | Mohr | 40/124.08 |
| 6,199,912 | B1 * | 3/2001 | Finkelshteyn | 283/117 |
| 7,455,738 | B2 * | 11/2008 | Patel et al. | 148/402 |

* cited by examiner

*Primary Examiner*—Joanne Silbermann
(74) *Attorney, Agent, or Firm*—E. Thomas Wheelock

(57) ABSTRACT

This description relates to a card construction that may be assembled from a paper material support and at least one bent wire formed into a character outline. The resulting bent wire-form may be held to the support with discrete areas of adhesive materials that are positioned to hold the character outline substantially in its mounted form and to (optionally) separate the character outline from the paper material support. The construction may be used as a greeting card, announcement card, artwork, label, or the like.

20 Claims, 4 Drawing Sheets

CARD CONSTRUCTION HAVING RAISED WIRE FIGURES

RELATED APPLICATIONS

This application derives benefit from provisional application for patent No. 60/845,984, filed Sep. 20, 2007.

FIELD

This description relates to a card construction that may be assembled from a paper material support and at least one bent wire formed into a character outline. The resulting bent wireform may be held to the support with discrete areas of adhesive materials that are positioned to hold the character outline substantially in its mounted form and to (optionally) separate the character outline from the paper material support. The construction may be used as a greeting card, announcement card, artwork, label, or the like.

SUMMARY

Described here is a card construct comprising (a) at least one paper material support, optionally folded, having at least one mounting surface, (b) at least one bent wire formed into a character outline, adhering to at least one of the at least one mounting surfaces, and (c) multiple, non-contiguous, discrete regions of adherent material adhering both to at least one of the at least one mounting surfaces and to at least one bent wire formed into a character outline. The paper material support may be at least one paper material selected from the group consisting of wood-based paper, rice-based paper, rag-based paper, polymer-based paper, relatively stiff cardboard, relatively flexible cardboard, KRAFT paper, plywood, neat wood, and mixtures, combinations, and laminates of one or more of the paper materials, particularly, at least one foldable paper material selected from the group consisting of wood-based paper, rice-based paper, rag-based paper, polymer-based paper, relatively stiff cardboard, relatively flexible cardboard, KRAFT paper, and mixtures, combinations, and laminates of one or more of the paper materials.

The wire may be a malleable metal or metal alloy wire, a shape memory metal alloy wire, such as a temperature memory wire material such as nitinol wire. If nitinol wire is selected, it may be of the type permitting change of the shape of the bent wire upon application of heat or cold to the wire.

The card construct may have the paper material support folded along a single fold to form at least one interior mounting surface and to form at least one exterior mounting surface and wherein at least one bent wire formed into a character outline is adherent to at least one interior mounting surface or at least one exterior mounting surface. The card construct may have the paper material support folded along more than one fold to form at least one interior mounting surface and to form at least one exterior mounting surface and wherein at least one bent wire formed into a character outline is adherent to at least one interior mounting surface or at least one exterior mounting surface.

The card construct may include one or more bent wire character outlines such as one or more members selected from the group consisting of: a realistic human face, a stylized human face, a caricature of a human face, bare outlines of faces or other body parts, animals, birds, insects, fish, plants, leaves, numerals, letters, English and non-English letters and numbers, symbols, vegetables, fruits, cityscapes, landscapes, celestial bodies, anthropomorphized stylizations of any of the preceding members. Of particular interest is a card construct where at least one of the bent wire character outlines comprises the outline of a human face, the outline of a human body part or parts, the outline of an animal part or face.

The card construct may use an adherent material, such as a clear or opaque Silicone-based material, and selected to provide separation of the at least one of the bent wire character outlines from the at least one mounting surfaces.

The paper material support may be at least partially cylindrical or substantially cylindrical. The cylindrical paper material support may further include a bottom component for maintaining contents within the support or configured to conform to a wine bottle shape or even be adherent to a wine bottle.

The card construct may further form a combination with an envelope sized to include the paper material support, the at least one bent wire formed into a character outline adhering to at least one of the at least one mounting surfaces, and the multiple, non-contiguous, discrete regions of adherent material.

DETAILED DESCRIPTION

The structure described here is straightforward: it is an assembled construction made up of (a) one or more paper material supports, optionally folded, (b) at least one bent wire formed into a generally recognizable outline (e.g., a letter, a number, a face, an animal, etc.), and (c) discrete, typically non-continuous, regions of adherent material holding that bent wireform to the support. The construction might be used as a greeting card, announcement card, a freestanding art work, or the like.

Figure 1:
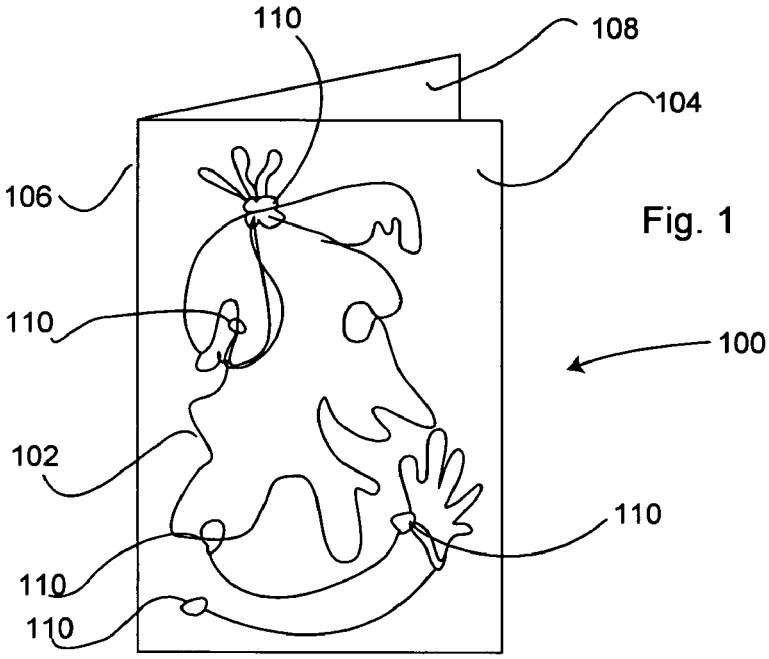
FIG. 1 shows one variation of the greeting card construction having a caricature face and hand bent from wire and mounted on the front surface of the bifold card. Regions of adhesive material are also shown. The card has a vertical fold.

FIG. 1 shows a first variation of the described the construction card 100 having a wireform caricature of a face and hand 102 bent from wire and mounted on a support of the paper material. The card 100 has a front surface 104, where the formed wire depiction 102 is mounted, a single vertical fold 106, and an interior surface 108. The wireform 102 in this variation is mounted to the front surface 104 of the card with an adhesive located in several discrete locations 110 selected both to hold the wireform 102 to the card during use and to maintain the shape of the wireform 102 after mounting.

The wireform 102 in this and the other variations described here may be of any shape or character outline, e.g., a realistic human face, a stylized human face, a caricature of a human face, bare outlines of faces or other body parts, animals, birds, insects, fish, plants, leaves, numerals, letters, English and non-English letters and numbers, symbols, vegetables, fruits, cityscapes, landscapes, celestial bodies, anthropomorphized stylizations of any of these listed subjects, and the like. Caricatures of human faces are of special interest as subjects.

By "paper material" is broadly meant any of a variety the materials used in constructing this type of structure. In particular, "paper material" may comprise at least one member selected from the group consisting of wood-based paper, rice-based paper, rag-based paper, polymer-based papers, comparatively flexible cardboard, comparatively stiff cardboard, Kraft paper, plywood, neat wood, and mixtures, combinations, and laminates of more than one of these materials.

By "wire" is broadly meant an elongated material, generally ductile and metallic, having a cross-section that is substantially circular or, at least, has a cross-sectional aspect ratio between about 1:2 and 2:1. Obviously, this description includes cross-sectional shapes that are of oval, round, square, rectangular, random, etc.

Although the wire may be ductile or malleable and thereby allow a card maker to construct a wireform that, upon such forming, would remain in a single shape after that initial construction, the wire may also comprise a "shape memory" metal alloy or material such as nitinol. Such alloys include the class of titanium/nickel materials known as nitinol—alloys discovered by the U.S. Navy Ordnance Laboratory. These materials are discussed at length in U.S. Pat. No. 3,174,851 to Buehler et al., U.S. Pat. No. 3,351,463 to Rozner et al., and U.S. Pat. No. 3,753,700 to Harrison et al. Commercial alloys containing up to about 5% or up to about 8% or more, of one or more other members of the iron group, e.g., Fe, Cr, Co, are considered to be encompassed within a useful class of such alloys. Nitinol alloys having a transition temperature just above room temperature are useful here. In this way, the card maker would have the option of making a wireform of one shape that would change shape upon a modest temperature elevation. Provisions for heating the wire, for instance, with a simple switched battery circuit configured to conduct current through the wireform, thereby to elevate its temperature and to change its shape may be included. Switching such a battery current on-and-off for a properly constructed butterfly would cause the wings to flap slowly.

Again, such a material should be the chosen to provide a phase change temperature in the appropriate temperature region of use. For instance, choosing a temperature memory alloy having a phase change temperature of 85° F. would, upon heating of the wireform to 100° F. via imposition of the battery current, cause the change of form.

The wire, ductile or shape memory, may be of any color or texture.

Figure 2:
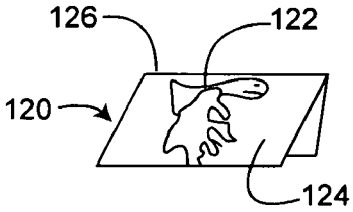
FIG. 2 shows another variation of the card construction where the caricature face is mounted on the front surface of a bifold card. The fold in this variation is a horizontal fold.

FIG. 2 shows another variation 120 of the card where the wireform 122 is mounted on the front surface 124 of the card 120. The fold 126 in this variation is horizontal.

Figure 3:
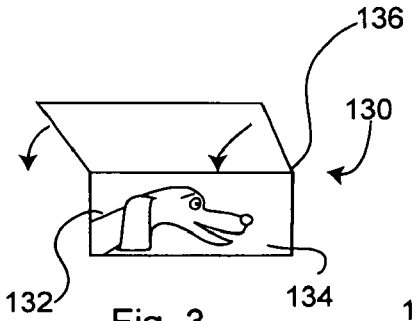
FIG. 3 shows another variation of the card construction where the wireform caricature is mounted on the interior surface of a horizontally folded bifold card.

FIG. 3 shows a variation of the card 130 having a wireform 132 of an animal, in this case mounted on an interior service 134 of the paper material support. The fold 136 is depicted to be horizontal.

Figure 4:
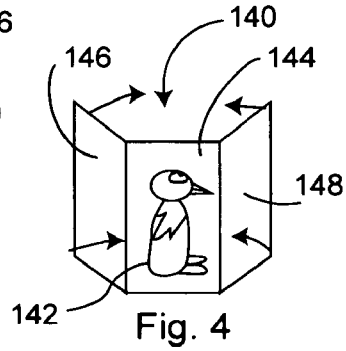
FIG. 4 shows another variation of the described construction where the wireform is mounted on an interior surface of a trifold card.

FIG. 4 shows a variation in which the card 140 is made up of a trifold paper material support. The wireform 142 is mounted on an interior surface 144. The wireform 142 depicts a bird. Two paper material support sections 146, 148 fold inwardly towards the wireform.

Figure 5:
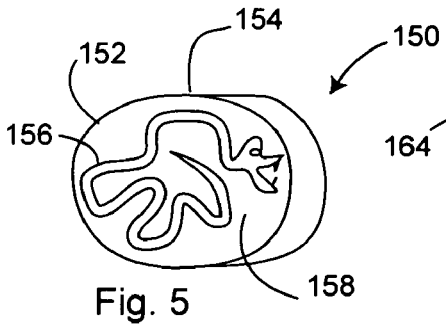
FIG. 5 shows a variation in which the card is non-square and non-rectangular. Specifically the card is depicted to have a curved edge and a single hinge at a folding region at the top. The animal wireform is an animal, a snake.

FIG. 5 shows a variation of the card construction 150 in which the edge 152 of the card is curved. The fold 154 is depicted at the top of the construction card 150. The wireform 156 is mounted on the front surface 158 of the card 150.

Figure 6:
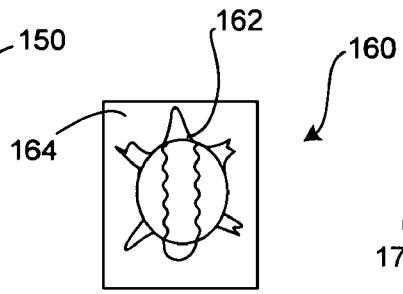
FIG. 6 shows another variation of the construction where the folded wire is mounted on the surface of the card support having no fold.

FIG. 6 shows another variation of the card construction 160 in which the wireform 162 is mounted on a paper material support 164. In this variation, the card is without any fold. The wire for 162 is an animal.

Figure 7:
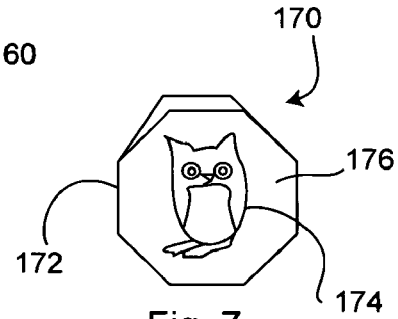
FIG. 7 shows a construction in which the card is generally hexagonal in shape and has a single vertical fold.

FIG. 7 depicts a straight sided variation 170 that is neither square nor rectangular. The overall shape of the card is hexagonal. In the depicted variation, the fold 172 is on the left of the card 170. The depicted bird wireform 174 is shown to be mounted on the front 176 of the construction 170.

Figure 8A:
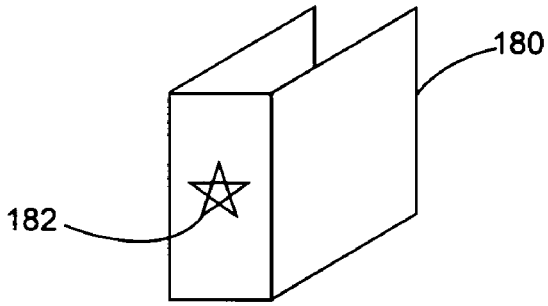
FIGS. 8A and 8B show constructions in which the support is generally in the form of a book cover.
Figure 8B:
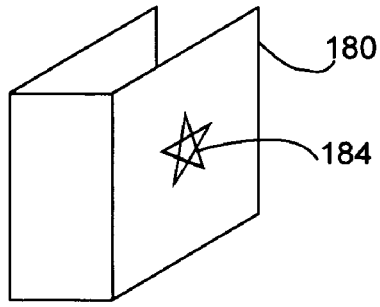

Other variations of the described construction include should be apparent from of the prior drawings. Such variations include, for instance as shown in FIGS. 8A and 8B, a paper material support in the form of a book jacket 180 with the wireform mounted on the spine (182 in FIG. 8A) or on the front surface (184 in FIG. 8B).

Figure 9A:
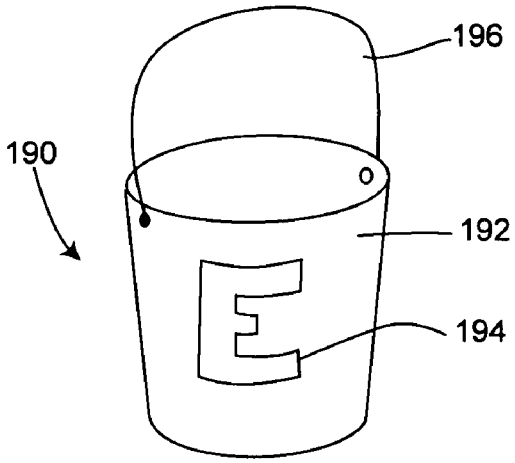
FIGS. 9A, 9B, and 9C show generally cylindrical constructions suitable as containers, e.g., gift containers and wine bottle containers, and as wine bottle labels.
Figure 9B:
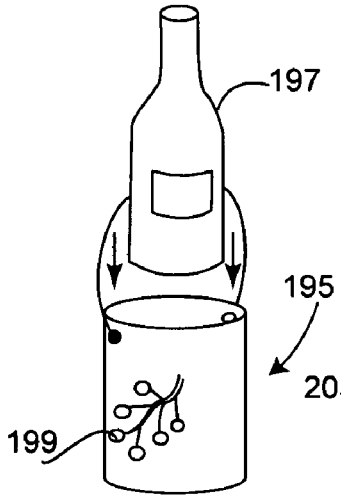
Figure 9C:
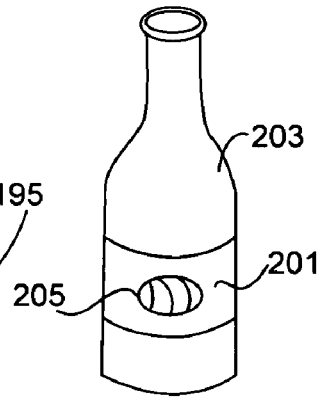

The paper material support need not be planar. For instance, as shown in FIGS. 9A, 9B, and 9C, the support may be partially or wholly cylindrical with the wireform mounted on the exterior surface. Such a cylindrical structure is shown in FIG. 9A, in the spirit of a gift container 190 having a support 192 with an adherent wireform 194—shown here to be a letter "E"—and having a handle 196.

FIG. 9B shows the same configuration as shown in FIG. 9A as gift container or carrier 195 for a wine bottle 197. The wireform 199 is in the form of a bunch of grapes. Obviously, the structures shown in FIGS. 9A and 9B will include some type of a bottom component to hold the contents.

FIG. 9C shows generally cylindrical card configuration 201 as the label on a wine bottle 203. The adherent wireform 205 is depicted as a symbol, a wine barrel.

Figure 10:
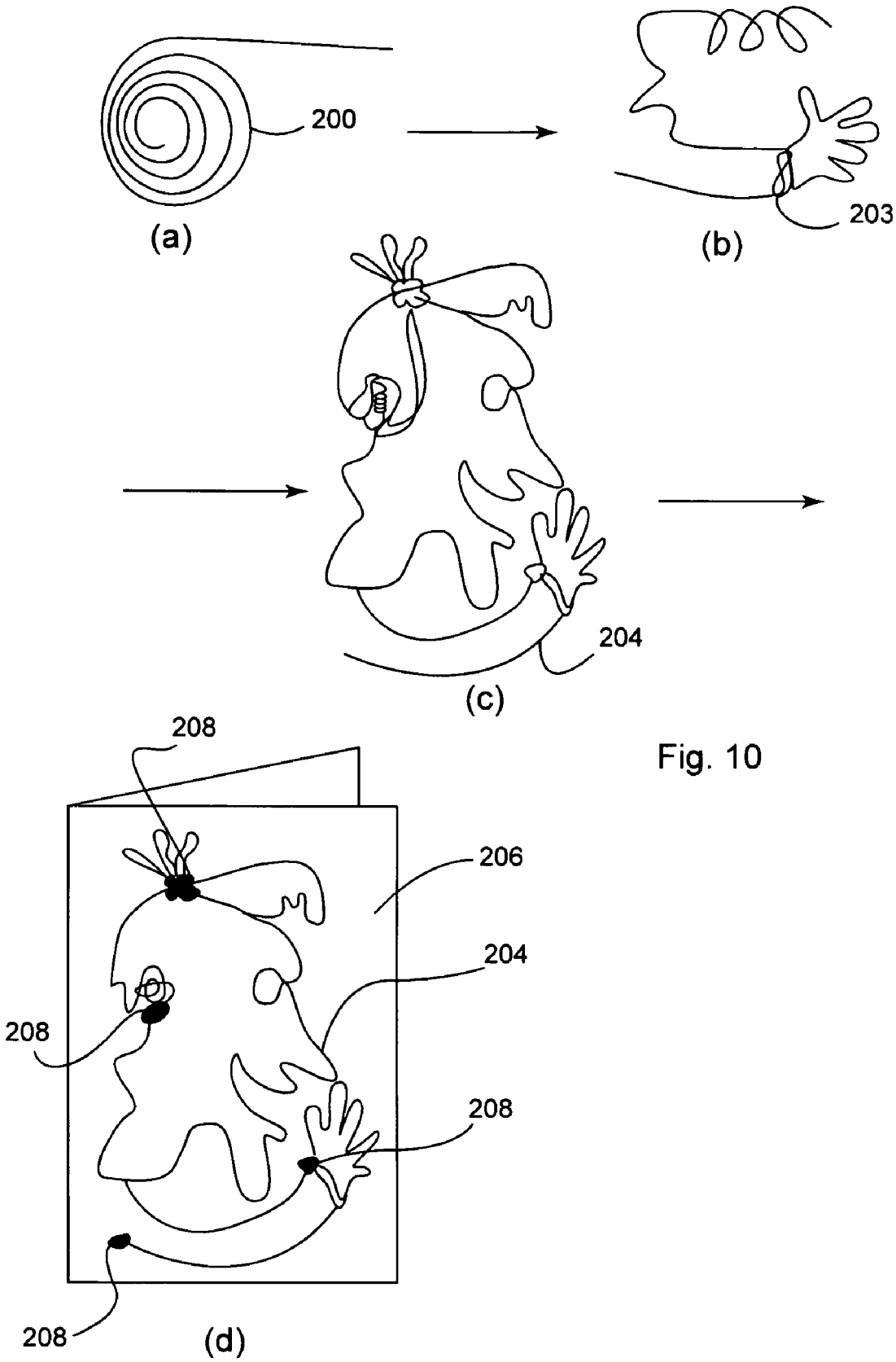
FIG. 10 shows a method of forming the described card construction.

FIG. 10 shows one way in which the card or construction described herein may be assembled. In step (a), an amount of wire 200 is provided. In step (b), the wire is formed into a portion 202 of the ultimate wireform. Step (c) the wireform 204 is completed. The completed wireform 204 is then mounted to paper material support 206 with an adhesive at the selected sites 208 as is described above.

Although the wireform 204 may be made to adhere to the paper material support 206 using a continuous or semi-continuous sheet of an adhesive, most often the wireform will be made to adhere to the support using such discrete regions of adhesive material. Viscous adhesives such as the Silicones (e.g., Dow Corning AS7096 sealant, Dow Corning 737 sealant, Dow Corning 748 sealant, Dow Corning 832 sealant, and the like) and hot melt PVA glues may be used to support the wireform and give the card visual depth.

Figure 11:
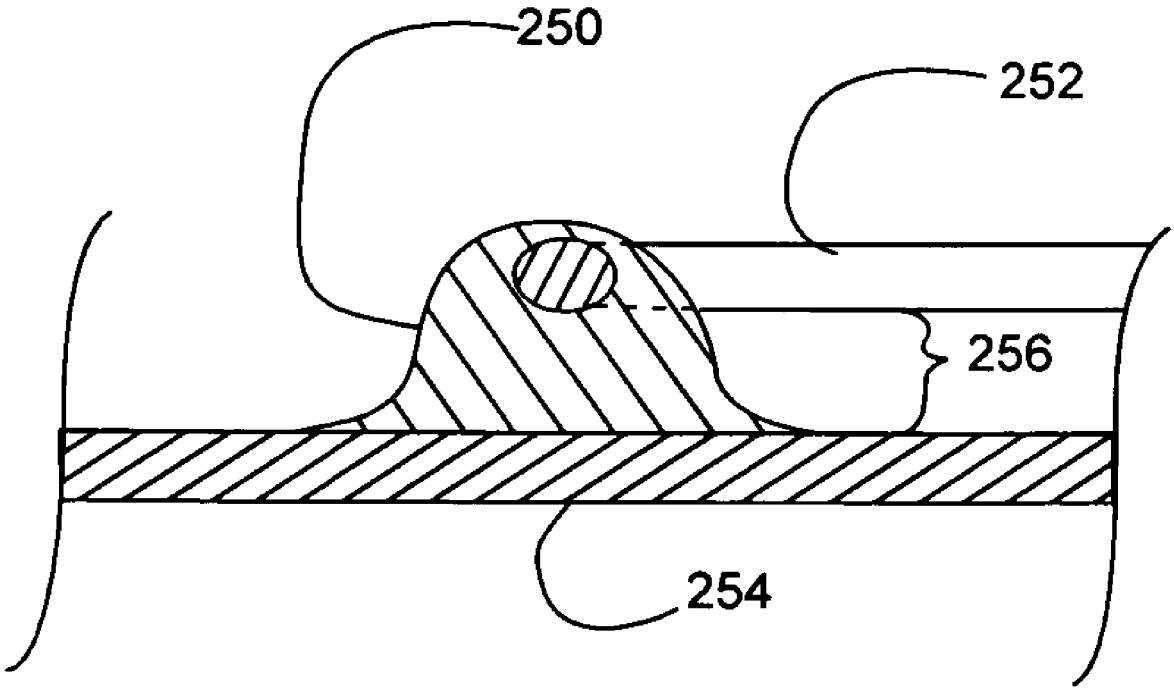
FIG. 11 is a partial cutaway showing an adhesive site supporting the wireform.

FIG. 11 shows a side-view cutaway of a card construction having a discrete region 250 of an adhesive material supporting the wireform 252 and spacing it from the paper material support 254 at a distance 256 from that support 254.

Included in the scope of this description is the combination of the construction described above with enclosing envelopes.

Other variations of the described card construct will be apparent to those of ordinary skill n this art. The inventor intends only to be limited only by the scope of any claims and their equivalents.

I claim as my invention:

1. A card construct comprising:

(a) at least one paper material support, optionally folded, having at least one mounting surface, (b) at least one bent wire formed into a character outline, adhering to and separated from the at least one of the at least one mounting surfaces, and (c) multiple, non-contiguous, discrete regions of adherent material adhering both to at least one of the at least one mounting surfaces and to at least one bent wire formed into a character outline and where the adherent material is selected to provide complete separation of the at least one bent wire from the at least one mounting surface and operatively to maintain complete separation of the at least one bent wire from the at least one mounting surface.

2. The card construct of claim 1 where the paper material support comprises at least one paper material selected from the group consisting of wood-based paper, rice-based paper, rag-based paper, polymer-based paper, relatively stiff cardboard, relatively flexible cardboard, KRAFT paper, plywood, neat wood, and mixtures, combinations, and laminates of one or more of the paper materials.

3. The card construct of claim 1 where the paper material support comprises at least one foldable paper material selected from the group consisting of wood-based paper, rice-based paper, rag-based paper, polymer-based paper, relatively stiff cardboard, relatively flexible cardboard, KRAFT paper, and mixtures, combinations, and laminates of one or more of the paper materials.

4. The card construct of claim 1 where the wire comprises a malleable metal or metal alloy wire.

5. The card construct of claim 1 where the wire comprises a shape memory metal alloy wire.

6. The card construct of claim 5 where the wire comprises nitinol wire.

7. The card construct of claim 6 where the nitinol wire is selected to permit change of the shape of the bent wire upon application of heat or cold to the wire.

8. The card construct of claim 1 where the paper material support is folded along a single fold to form at least one interior mounting surface and to form at least one exterior mounting surface and wherein at least one bent wire formed into a character outline is adherent to at least one interior mounting surface or at least one exterior mounting surface.

9. The card construct of claim 1 where the paper material support is folded along more than one fold to form at least one interior mounting surface and to form at least one exterior mounting surface and wherein at least one bent wire formed into a character outline is adherent to at least one interior mounting surface or at least one exterior mounting surface.

10. The card construct of claim 1 where at least one of the bent wire character outlines comprises one or more members selected from the group consisting of: a realistic human face, a stylized human face, a caricature of a human face, bare outlines of faces or other body parts, animals, birds, insects, fish, plants, leaves, numerals, letters, English and non-English letters and numbers, symbols, vegetables, fruits, cityscapes, landscapes, celestial bodies, anthropomorphized stylizations of any of the preceding members.

11. The card construct of claim 1 where at least one of the bent wire character outlines comprises the outline of a human face.

12. The card construct of claim 1 where at least one of the bent wire character outlines comprises the outline of a human body part or parts.

13. The card construct of claim 1 where at least one of the bent wire character outlines comprises the outline of an animal part or face.

14. The card construct of claim 1 where the adherent material comprises a clear or opaque Silicone-based material.

15. The card construct of claim 1 where the paper material support is at least partially cylindrical.

16. The card construct of claim 15 where the at least partially cylindrical paper material support is configured to conform to a wine bottle shape.

17. The card construct of claim 15 where the at least partially cylindrical paper material support is adherent to a wine bottle.

18. The card construct of claim 1 where the paper material support is substantially cylindrical.

19. The card construct of claim 18 where the cylindrical paper material support further comprises a bottom component for maintaining contents within the support.

20. The card construct of claim 18 further comprising attached carrying handles.

* * * * *